US007878797B1

(12) United States Patent
Swanson et al.

(10) Patent No.: US 7,878,797 B1
(45) Date of Patent: Feb. 1, 2011

(54) BURNER ASSEMBLY WITH SCREEN

(75) Inventors: Malcolm Swanson, Chickamauga, GA (US); Michael Swanson, Chickamauga, GA (US)

(73) Assignee: Astec, Inc., Chattanooga, TN (US)

( * ) Notice: Subject to any disclaimer, the term of this patent is extended or adjusted under 35 U.S.C. 154(b) by 1086 days.

(21) Appl. No.: 11/436,332

(22) Filed: May 18, 2006

Related U.S. Application Data

(63) Continuation-in-part of application No. 10/957,252, filed on Oct. 1, 2004, now abandoned.

(51) Int. Cl.
*F23C 5/08* (2006.01)

(52) U.S. Cl. ..... 431/181; 431/183; 431/187; 431/284

(58) Field of Classification Search ..... 431/181, 431/182, 183, 187, 284, 285, 352, 350
See application file for complete search history.

(56) References Cited

U.S. PATENT DOCUMENTS 4,298,337 A * 11/1981 Butler et al. ..... 431/285
4,762,488 A * 8/1988 Schilling ..... 431/350
5,573,396 A * 11/1996 Swanson ..... 432/106

* cited by examiner

*Primary Examiner*—Alfred Basichas
(74) *Attorney, Agent, or Firm*—Chambliss, Bahner & Stophel, P.C.

(57) ABSTRACT

A burner assembly including a housing having an air inlet and a burner end, a motor, and an impeller mounted in the housing. The impeller is in fluid communication with the air inlet, in mechanical communication with the motor, and adapted to direct air from the air inlet towards the burner end of the housing. The burner assembly also includes at least one pre-mix gas injection nozzle mounted in the housing. Each of the at least one pre-mix gas injection nozzle has at least one orifice adapted to direct gaseous fuel into the housing. The burner assembly further includes a spin vane comprising at least one spin vane blade. The spin vane is mounted in the burner end of the housing and adapted to direct the flow of air in the burner end. The burner assembly still further includes a flattening screen located in the housing downstream from the impeller and an igniter mounted in the burner end of the housing. The igniter is adapted to ignite the air and fuel mixture in the burner end of the housing to produce a main flame.

22 Claims, 16 Drawing Sheets

BURNER ASSEMBLY WITH SCREEN

RELATED APPLICATIONS

This is a continuation-in-part application of patent application entitled Burner Assembly, which was filed on Oct. 1, 2004 now abandoned and assigned Ser. No. 10/957,252.

FIELD OF THE INVENTION

This invention relates generally to an improved burner assembly, and more particularly, to an improved burner assembly for heating and drying aggregate materials used in connection with the production of hot mix asphalt.

BACKGROUND AND DESCRIPTION OF THE PRIOR ART

It is known to use a burner assembly to heat and dry aggregate materials used in connection with the production of hot mix asphalt. See, e.g., U.S. Pat. No. 5,700,143, U.S. Pat. No. 5,511,970, U.S. Pat. No. 4,559,009 and U.S. Pat. No. 4,298,337. However, conventional burner assemblies suffer from several disadvantages. For example, conventional burner assemblies are incapable of producing a flame configuration satisfactory for asphalt production in a variety of different-sized combustion chambers. As a result, burner assemblies typically include adjustable spin vanes or spin racks to accommodate different-sized combustion chambers. For example, U.S. Pat. No. 6,488,496 of Feese et al. describes a compact combination burner with an adjustable spin rack. Adjustable spin vanes, however, increase the cost of manufacture and maintenance, and the amount of labor required to operate the burner. It would be desirable, therefore, if an apparatus could be provided that would selectively fire on gaseous fuel, liquid fuel, or both gaseous and liquid fuel. It would also be desirable if such an apparatus could be provided that would fire on gaseous and/or liquid fuels without physically altering the components of the apparatus, changing the firing rate of the apparatus, or shutting down the apparatus. It would be further desirable if such apparatus could be provided that would fire on oil or liquid propane without changing the atomizing nozzle. It would be still further desirable if such an apparatus could be provided that would supply natural gas or propane around the atomizing nozzle for use as pilot fuel. In addition, it would be desirable is such an apparatus could be provided that would produce a stable flame configuration having a short flame length and a narrow flame diameter adapted for use on a wide variety of different-sized combustion chambers. It would also be desirable if such an apparatus could be provided that would more completely and uniformly mix fuel and air in order to obtain more rapid combustion and improve combustion intensity, thereby reducing the combustion space required in the asphalt drum and lowering carbon monoxide (CO) emissions in the combustion space. It would be still further desirable if such an apparatus could be provided that would achieve reduced emissions of the oxides of nitrogen (NOx). In addition, it would be desirable if such an apparatus could be provided that would be capable of firing on low excess air pre-mix gas. It would also be desirable if such an apparatus could be provided that would produce a stabilizing gas base flame. It would be further desirable if such an apparatus could be provided that would reduce the temperature of the dryer drum breech plate where the burner is mounted. It would be still further desirable if such an apparatus could be provided that would eliminate the need to adjust spin vanes to achieve a desired flame configuration. It would also be desirable if such an apparatus could be provided that would be less complicated and expensive to manufacture, operate and maintain than conventional burners.

ADVANTAGES OF THE INVENTION

Accordingly, it is an advantage of the invention described and claimed herein to provide an apparatus capable of selectively firing on gaseous fuel, liquid fuel, or both gaseous and liquid fuel. It is also an advantage of the invention described and claimed herein to provide an apparatus capable of firing on gaseous and/or liquid fuels without physically altering the components of the apparatus, changing the firing rate of the apparatus, or shutting down the apparatus. It is a further advantage of the invention described and claimed herein to provide an apparatus adapted to fire on oil or liquid propane without changing the atomizing nozzle. It is another advantage of the invention described and claimed herein to provide an apparatus that is capable of supplying natural gas or propane to the atomizing nozzle for use as pilot fuel. It is also an advantage of the invention described and claimed herein to provide an apparatus for producing a stable main flame configuration that has a short flame length and a narrow flame diameter. It is also an advantage of the invention described and claimed herein to provide an apparatus for producing a main flame configuration that is adapted for use on a wide variety of different-sized combustion chambers having different-sized combustion spaces. It is another advantage of the invention described and claimed herein to provide an apparatus that more rapidly, completely, and uniformly mixes fuel and air, thereby providing a more rapid combustion, improving combustion intensity, reducing the combustion space required in the asphalt drum, and reducing CO emissions in the combustion space. It is yet another advantage of a preferred embodiment of the invention described and claimed herein to reduce NOx emissions.

It is a further advantage of the invention described and claimed herein to provide an apparatus having the capability of firing on low excess air pre-mix gas. It is a still further advantage of the invention described and claimed herein to provide an apparatus for producing a stabilizing gas base flame. It is still another advantage of the invention described and claimed herein to provide an apparatus that reduces the temperature of the dryer drum breech plate. It is a further advantage of the invention described and claimed herein to provide an apparatus that eliminates the need for adjustable spin vanes in order to achieve a desired flame configuration. It is another advantage of the invention described and claimed herein to provide an apparatus having improved aerodynamics which reduce energy consumption and body pressure and produce a more free flowing burner assembly. It is still another advantage of the invention described and claimed herein to provide an apparatus which produces reduced noise levels during operation. It is yet another advantage of the invention described and claimed herein to provide an apparatus that is less complicated and expensive to manufacture, operate and maintain than conventional burner assemblies.

Additional advantages of the invention will become apparent from an examination of the drawings and the ensuing description.

EXPLANATION OF TECHNICAL TERMS

As used herein, the term "mounted about the periphery of the housing" means that the at least one pre-mix gas injection nozzle is mounted within the interior of the housing of the burner assembly such that the nozzles do not extend to center of housing. More particularly, the term "mounted about the periphery of the housing" means that the at least one pre-mix gas injection nozzle is mounted within the interior of the housing of the burner assembly such that the nozzles leave an open area in the center of the housing through which the primary air tube, the pilot assembly and the like may pass unimpeded.

As used herein, the term "centrally located in the housing" means that the pilot assembly is located and arranged in the housing of the burner assembly such that it passes through the open area in the center of the housing produced by the arrangement of the pre-mix gas injection nozzles.

As used herein, the term "screen" refers to any structure, mechanism, device or combination adapted to alter or change the directional flow of fluid in the housing of the burner assembly. The term "screen" includes, but is not limited to, coarse wire mesh constructions, large sieve structures and riddle-like devices.

SUMMARY OF THE INVENTION

The invention claimed herein comprises a burner assembly including a housing having an air inlet and a burner end, a motor, and an impeller mounted in the housing. The impeller is in fluid communication with the air inlet, in mechanical communication with the motor, and adapted to direct air from the air inlet towards the burner end of the housing. The burner assembly also includes at least one pre-mix gas injection nozzle mounted in the housing. Each of the at least one pre-mix gas injection nozzle has at least one orifice adapted to direct gaseous fuel into the housing. The burner assembly further includes a spin vane comprising at least one spin vane blade. The spin vane is mounted in the burner end of the housing and adapted to direct the flow of air in the burner end. The burner assembly still further includes a flattening screen located in the housing downstream from the impeller and an igniter mounted in the burner end of the housing. The igniter is adapted to ignite the air and fuel mixture in the burner end of the housing to produce a main flame.

In a preferred embodiment, the burner assembly further includes a straightening screen, a mixing screen and a liquid fuel system. In this preferred embodiment, an primary air tube is mounted within the housing. The primary air tube has an inlet end located downstream of the impeller and an outlet end located adjacent to the burner end. Also in this preferred embodiment, an atomizing nozzle is mounted on the outlet end of the primary air tube, a liquid fuel supply tube is mounted within the primary air tube so as to convey liquid fuel to the atomizing nozzle, a compressed atomizing air supply tube is mounted within the primary air tube so as to convey compressed air to the atomizing nozzle, and a ring is mounted around the periphery of the outlet end of the primary air tube. Also in a preferred embodiment of the burner assembly of the invention, a converging focusing cone and a diverging conical discharge section are mounted to the burner end, and a stabilizing gas base flame and a centrally-located pilot are provided in the burner end of the burner assembly.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
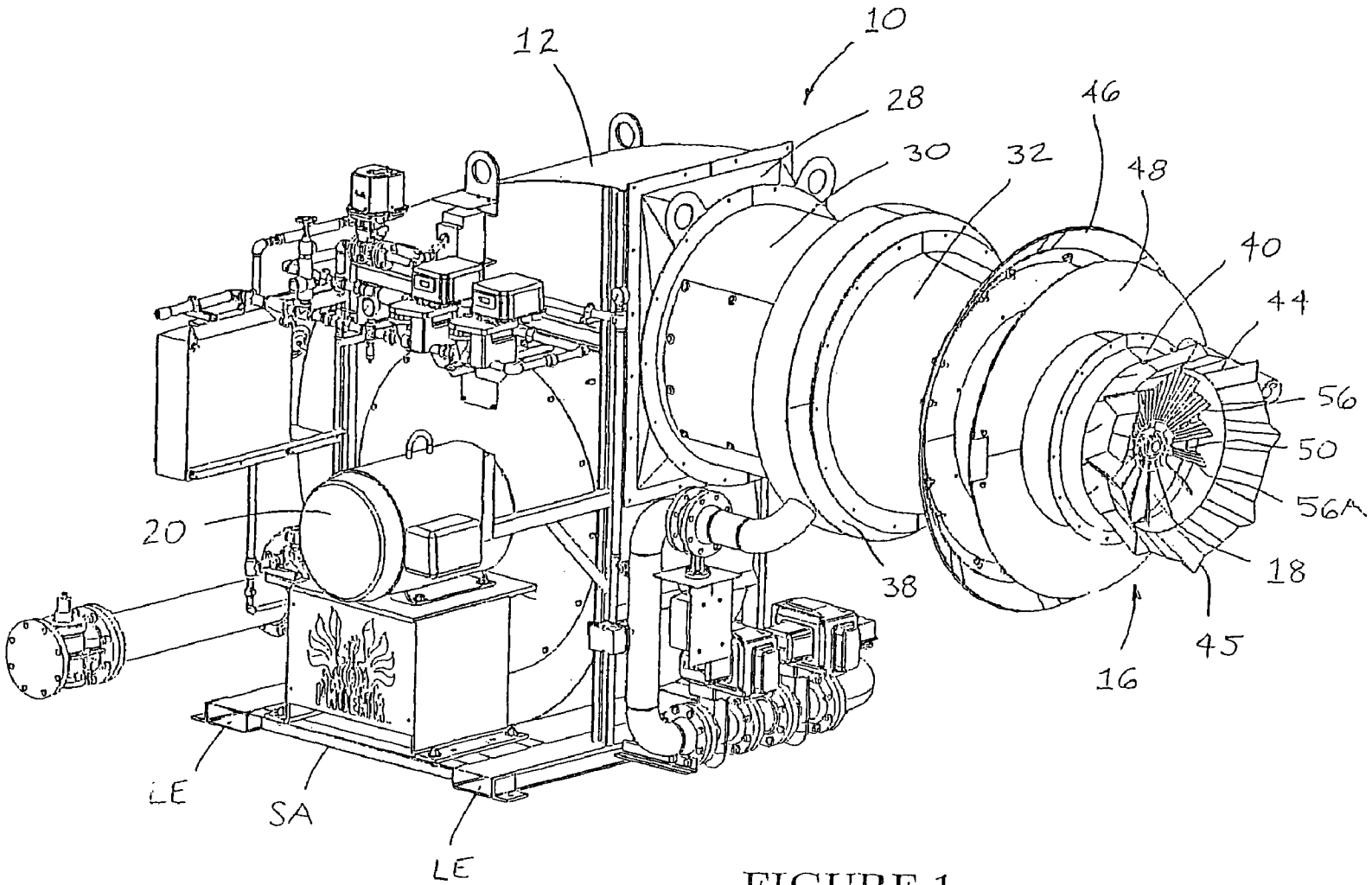
FIG. 1 is a perspective view of a preferred embodiment of the burner assembly in accordance with the present invention.

Referring now to the drawings, the apparatus of the invention described herein is illustrated by FIGS. 1 through 17. As shown in FIGS. 1 through 7, the preferred burner assembly is designated generally by reference numeral 10. The preferred burner assembly 10 is built on skid assembly SA having lifting tubes LE that allow the assembly to be handled with a fork truck or hoist. The preferred burner assembly is adapted to selectively fire on a gaseous fuel such as natural gas or a liquid fuel such as fuel oil, or both.

Referring still to FIGS. 1 through 7, the preferred burner assembly 10 comprises housing 12 having air inlet 14 (See FIGS. 3 and 6) and burner end 16 downstream from the air inlet. The preferred housing 12 generally contains the working components of the burner assembly and provides an outer shell within which combustion air may be pressurized, conveyed from the air inlet to the burner end, and mixed with fuel to produce a flame at the burner end of the housing burner end 16 is provided with opening 18 through which a flame is developed and burned. While FIGS. 1 through 7 illustrate a preferred configuration for housing 12, it is understood that housing 12 may be of any suitable configuration. It is also contemplated within the scope of the invention that housing 12 may be either a unitary structure or a modular structure comprising two or more separable components.

Figure 2:
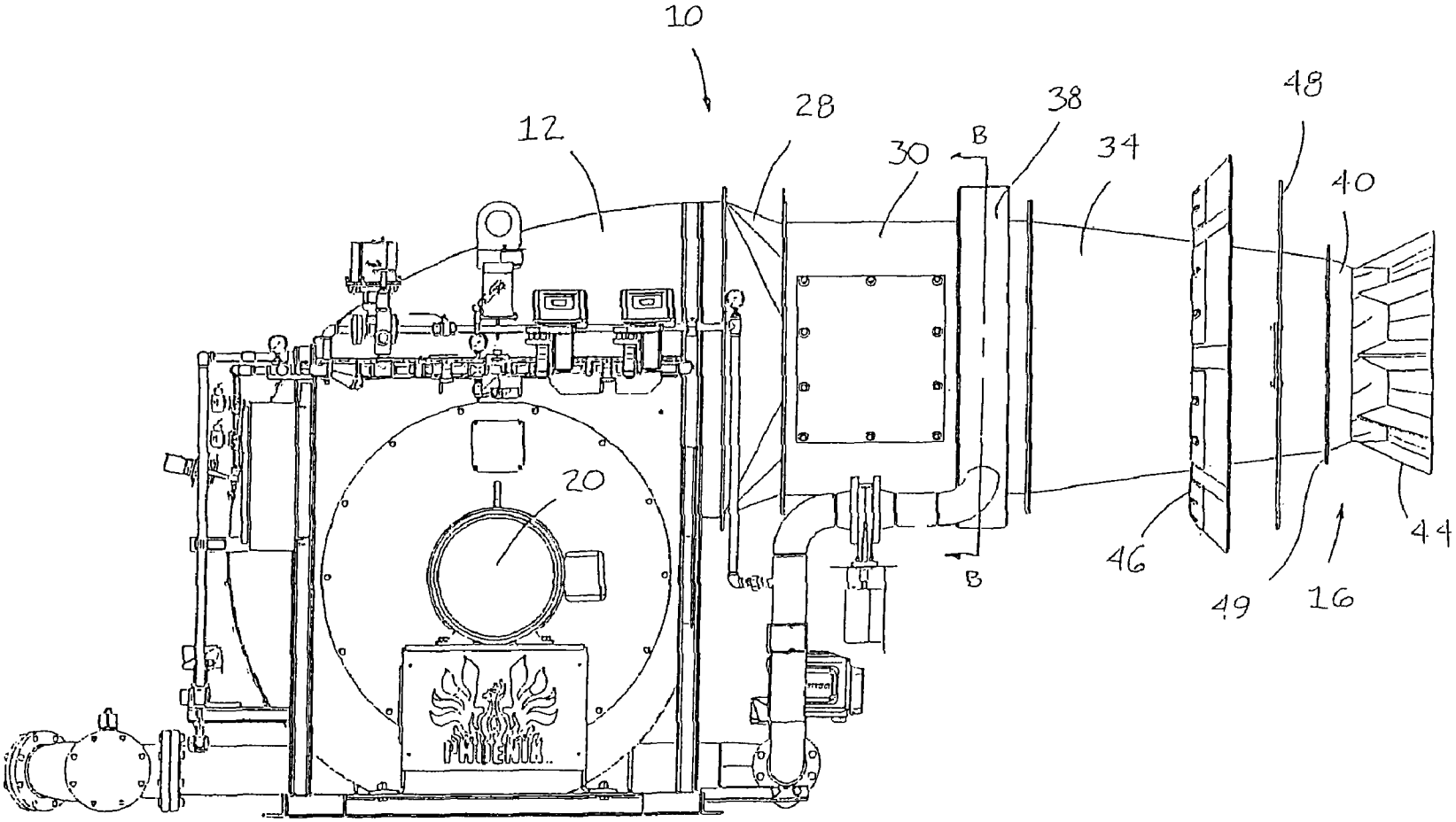
FIG. 2 is a front view of the preferred embodiment of the burner assembly illustrated in FIG. 1.
Figure 3:
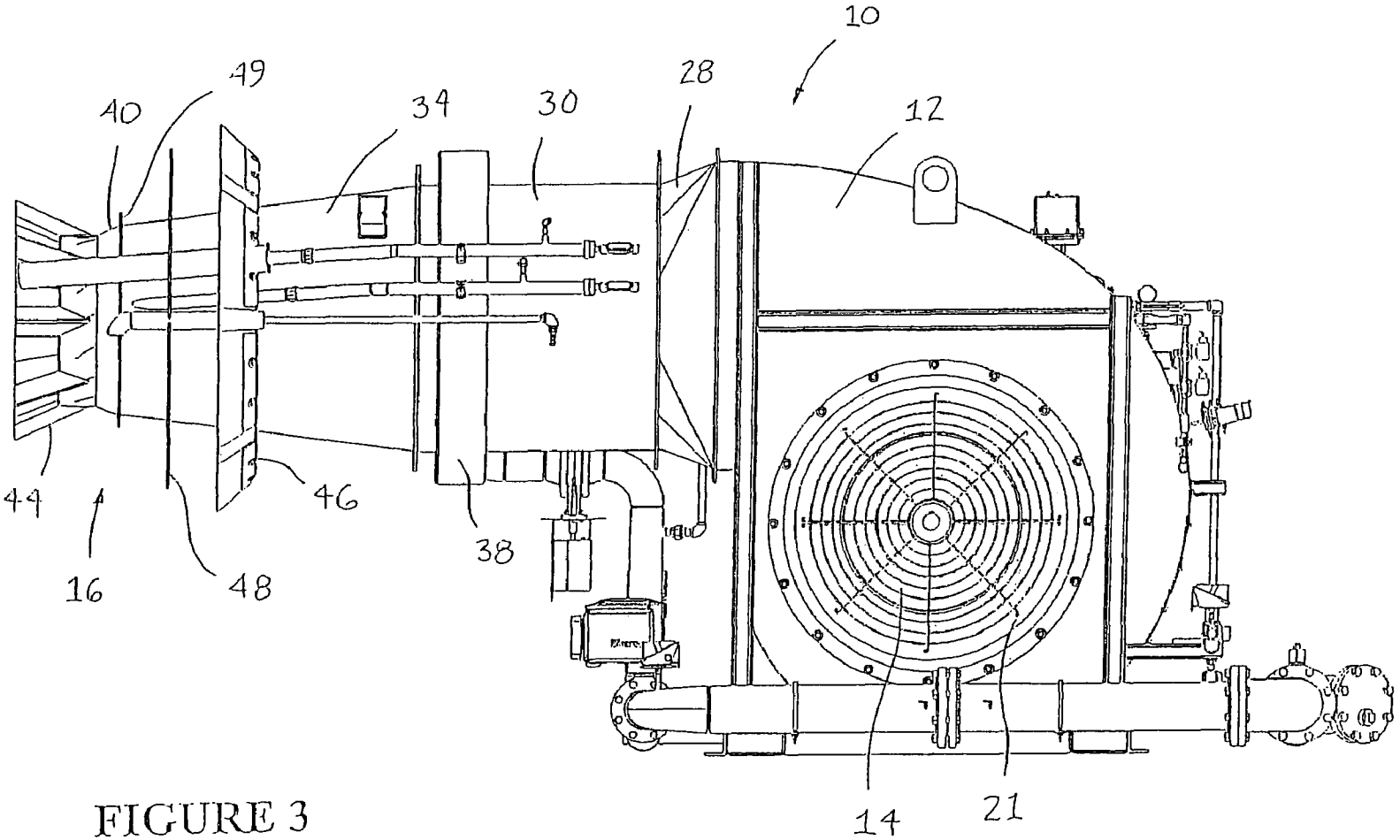
FIG. 3 is a rear view of the preferred embodiment of the burner assembly illustrated in FIGS. 1-2.

As shown in FIGS. 1 through 3, the preferred burner assembly 10 also includes motor 20. The preferred motor 20 is in mechanical communication with impeller 21 such as by being mounted to a shaft (not shown) that is connected to impeller 21 (See FIG. 3). The preferred impeller 21 is adapted to draw air into the housing through air inlet 14 (See FIG. 3) and convey pressurized air from the air inlet downstream towards the burner end of housing 12. The preferred air inlet 14 is adapted to supply air to the burner assembly. The preferred motor 20 promotes high combustion air exit velocities and rapid mixing for higher combustion intensity. The preferred motor 20 is also a variable frequency AC motor and is adapted to vary the speed of impeller 21, thereby varying the flow of air in the housing of the burner assembly. While the preferred motor is a variable frequency AC motor, it is contemplated within the scope of the invention that any suitable device for conveying pressurized air towards the burner end of the assembly may be used. The preferred impeller 21 may be a backward curved impeller or any other suitable device for conveying pressurized air.

Referring still to FIGS. 1 through 3, the preferred burner assembly 10 also includes transition section 28, gas injection section 30 and pre-mix cone 34. The preferred transition section 28 is mounted to the housing downstream of the impeller and adapted to direct air flow from the impeller to the burner end. The preferred gas injection section 30 is mounted to the transition section downstream of the impeller and adapted to direct air flow from the impeller to the burner end. More particularly, the preferred gas injection section 30 includes at least one pre-mix gas injection nozzle 36 (See FIGS. 8-10). The preferred pre-mix gas injection nozzles 36 are adapted to provide gaseous fuel such as natural gas to the interior of the gas injection section via gas manifold 38. The preferred pre-mix cone 34 is located downstream of the impeller and adapted to direct air flow from the impeller to the burner end. More particularly, the preferred pre-mix cone 34 is adapted to facilitate the complete and uniform mixing of fuel and air in the burner assembly. In a preferred embodiment, the pre-mix cone is constructed with an included angle of approximately 15°, i.e., approximately 7½° from parallel to the longitudinal axis on the pre-mix cone on each opposing side.

Still referring to FIGS. 1 through 3, the preferred burner assembly 10 further includes converging focusing cone 40 and diverging conical discharge section 44 which are located in the burner end of the housing. The preferred converging focusing cone 40 is removably mounted to the burner assembly and adapted to provide adequate air flow velocity in the burner end of the housing in order to prevent flashbacks. It is contemplated within the scope of the invention that a spin (or swirl) ring (not shown), such as is described and claimed in commonly assigned and copending application Ser. No. 10/356,288, may be mounted on the converging focusing cone in order to improve the configuration of the flame produced at the burner end of the assembly.

Referring still to FIGS. 1 through 3, the preferred diverging conical discharge section 44 is adapted to reduce CO emissions and shape and stabilize the flame produced at the burner end of the assembly. More particularly, the diverging conical discharge section 44 is adapted to act as a heat or radiation shield when the burner assembly is firing on oil. When the burner assembly is firing on gaseous fuel, the preferred diverging conical discharge section 44 acts as a "flame holder." The preferred diverging conical discharge section is welded to the adjustable opening band. It is contemplated within the scope of the invention, however, that the diverging conical cone may comprise more than one component connected together in any suitable manner. Also in a preferred embodiment, the diverging conical discharge section is constructed with an included angle of approximately 35°, i.e., approximately 17½° from parallel to the longitudinal axis of the pre-mix cone on each opposing side. The preferred burner assembly 10 also includes seal skirt 46 and heat shield 48 at the burner end of the housing. Seal skirt 46 and heat shield 48 are adapted to produce a sealed connection between the burner assembly and the dryer drum with which the burner assembly is used. Further, the preferred seal skirt 46 and the preferred heat shield 48 are mounted adjacent to the burner end and adapted to be attached to a rotating drum dryer and prevent air from entering the dryer drum as a result of the close clearance between the heat shield and the dryer drum.

Figure 15:
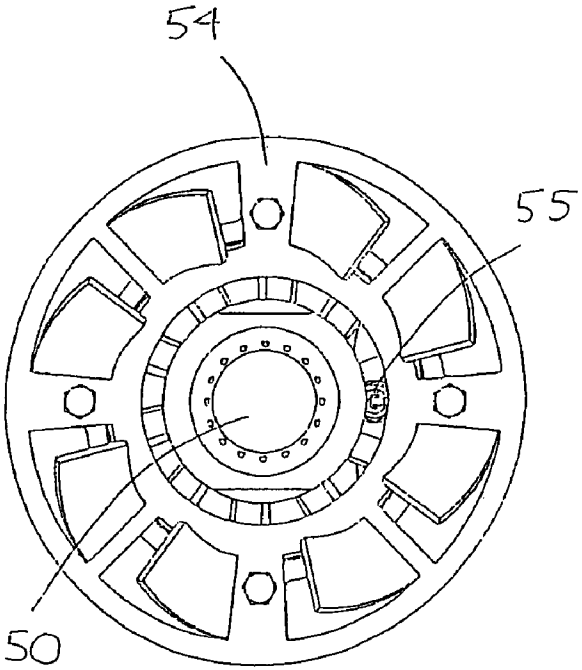
FIG. 15 is a right side view of the preferred pilot assembly of the burner assembly illustrated in FIGS. 1-14.
Figure 16:
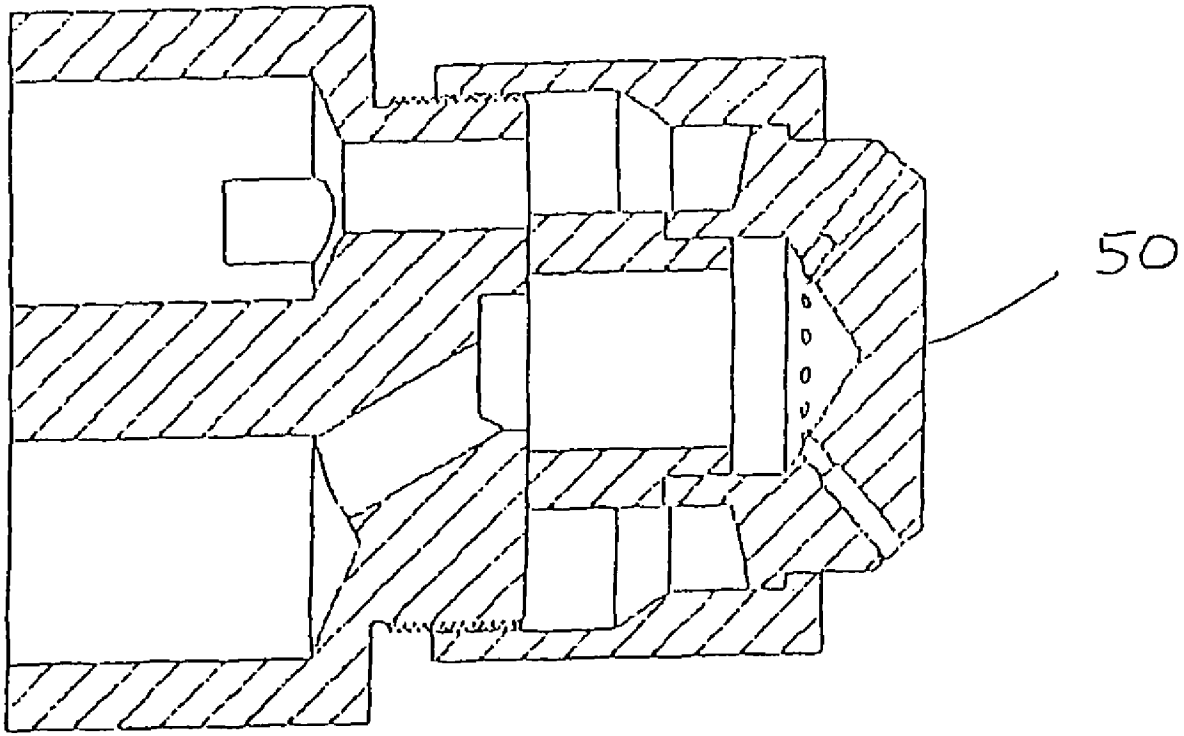
FIG. 16 is a sectional front view of a preferred embodiment of the atomizing nozzle of the burner assembly illustrated in FIGS. 1-15.

Referring now to FIGS. 1, 4, 6, 7 and 14 through 16, the preferred burner assembly 10 also includes atomizing nozzle 50 and pilot assembly 52 (See FIGS. 14 through 16) mounted at the burner end of the burner assembly. The preferred atomizing nozzle 50 is adapted to provide liquid fuel such as fuel oil to the burner end of the housing. The preferred atomizing nozzle 50 is also adapted to fire on gaseous fuel such as natural gas or lean-burn gas, oil or liquid propane. As shown in FIG. 16, the preferred atomizing nozzle 50 is a compressed air-type nozzle such as the nozzle commonly known as the "Y-Jet" type nozzle. The preferred atomizing nozzle 50 is a "Y-Jet" multi-angle atomizing nozzle which has no seals. It is contemplated within the scope of the invention, however, that the atomizing nozzle may be any suitable compressed air-type atomizing nozzle adapted to atomize fluids to be used to produce a flame such as a pintle-style nozzle.

Figure 14:
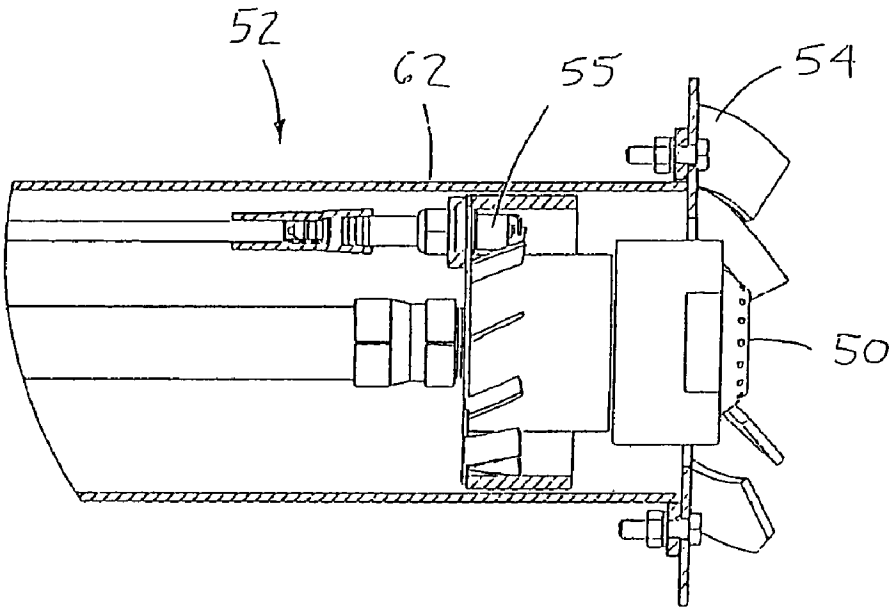
FIG. 14 is a partial sectional front view of a preferred embodiment of the pilot assembly of the burner assembly illustrated in FIGS. 1-13.

Referring now to FIGS. 14 through 15, a preferred embodiment of the pilot assembly 52 of the preferred burner assembly 10 is illustrated. More particularly, the preferred pilot assembly 52 is mounted at the burner end and adapted to produce a pilot flame for igniting the main flame. The preferred pilot assembly 52 is centrally located in the burner end of the housing of the burner assembly and surrounds at least a portion of the atomizing nozzle. As shown in FIG. 14, the preferred pilot assembly 52 uses existing geometry to produce a pilot flame. Indeed, the preferred pilot assembly 52 uses primary air tube 62 for the delivery of natural gas or propane to atomizing nozzle 50. While the preferred nozzle assembly 52 illustrated in FIGS. 14 and 15 is a pre-mix pilot, it is also contemplated within the scope of the invention that the nozzle assembly of the burner assembly described and claimed herein may be a nozzle mix pilot assembly.

Figure 5:
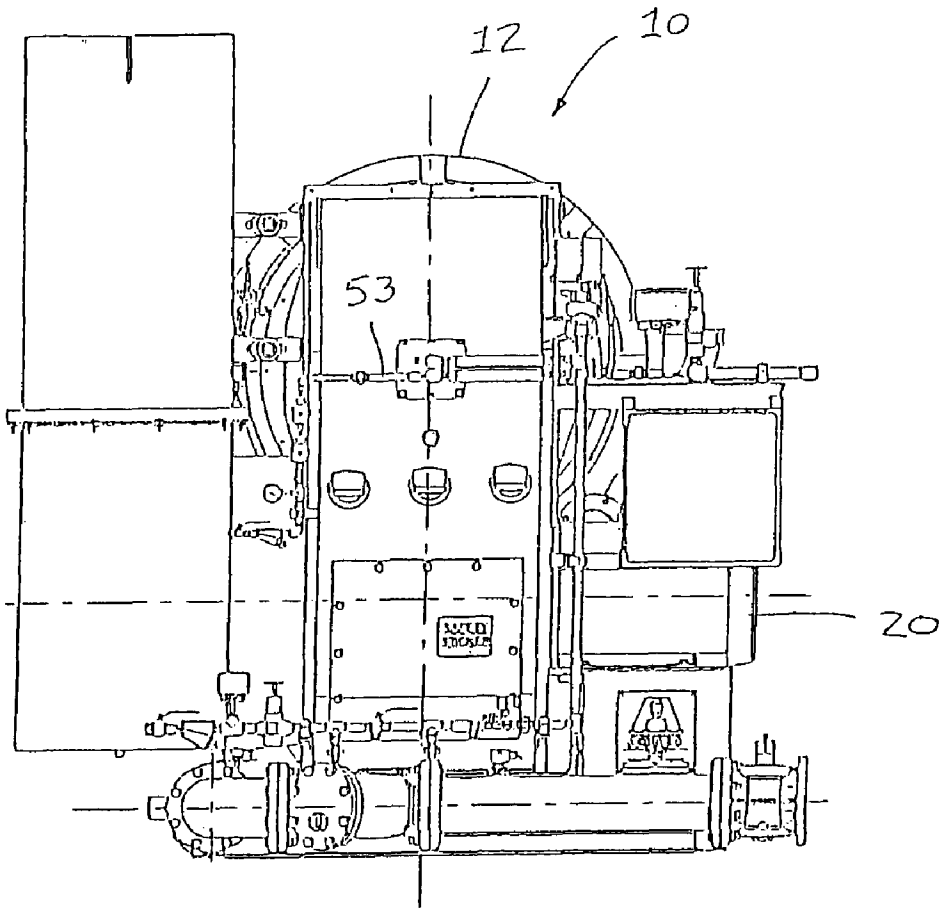
FIG. 5 is a left side view of the preferred embodiment of the burner assembly illustrated in FIGS. 1-4.

Referring still to FIGS. 14 and 15, the preferred pilot assembly 52 is adapted to ignite the mixture of fuel and air in the burner end of the burner assembly. The preferred pilot assembly 52 includes igniter 55 for igniting the mixture of fuel and air in the burner end, but it is contemplated within the scope of the invention that any suitable source of ignition may be used. As shown in FIG. 5, the preferred pilot assembly 52 includes pilot train 53 which enters the housing of the burner assembly such that the pilot assembly may be centrally located in the burner assembly.

Figure 15A:
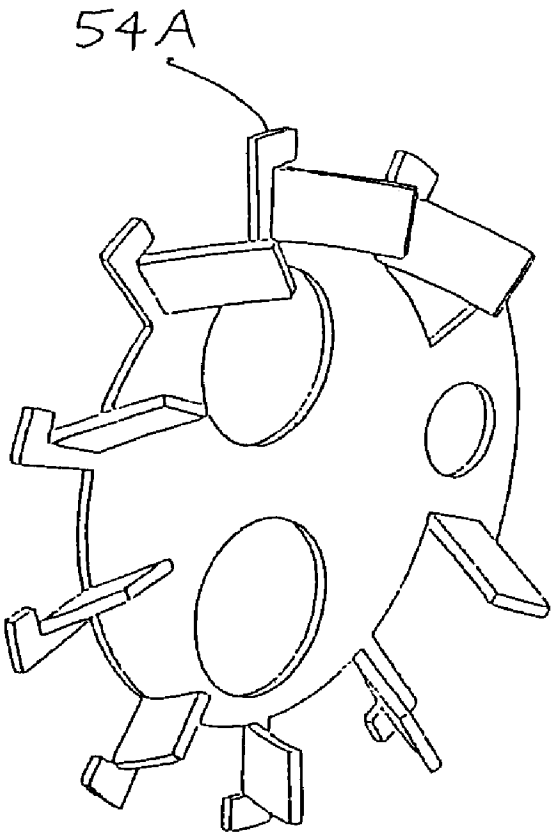
FIG. 15A is a perspective view of an exemplary flapped ring which may mounted in the burner end of the preferred burner assembly of the present invention.

As shown in FIGS. 14 and 15, swirl plate 54 is mounted around the periphery of the outlet end of atomizing nozzle 50. The preferred swirl plate 54 is adapted to direct air flow in the area of atomizing nozzle 50 in order to facilitate the mixture of combustion air and fuel. While FIGS. 14 and 15 illustrate a swirl plate mounted around the periphery of the outlet end of the primary air tube, it is contemplated within the scope of the invention that flapped ring 54A (See FIG. 15A) or any other suitable device adapted to facilitate the mixture of combustion air and fuel such as a flat round disk having no flaps or slots may be mounted at the burner end. It is also contemplated that the outlet end of the primary air tube may not include a swirl plate or any other similar device.

Referring now to FIGS. 1, 4, 6 and 11-13, in the preferred embodiment of the burner assembly, spin vane 56 is mounted in the burner end of the assembly upstream of atomizing nozzle 50 and pilot assembly 52. The preferred spin vane 56 is adapted to contribute to the swirling flow of air in the burner end of the burner assembly in order to more completely and uniformly mix the fuel and air in the burner assembly. In addition, the preferred spin vane 56 functions as a stabilizing structure for the main flame produced at the burner end of the burner assembly. The preferred spin vane 56 is mounted radially in the burner end of the burner assembly in an overlapping "pin wheel" configuration. Further, the preferred spin vane 56 is not adjustable. Still further, the preferred spin vane 56 includes a plurality of spin vane blades 56A, each of which is tapered and curved or bent such that the cross-sectional shape of each spin vane blade is non-planar. The tapered configuration of the preferred spin vanes 56 reduces air starvation near the center of the burner end. The non-planar configuration of the preferred spin vanes 56 improves the strength of the spin vane and the resistance to warping.

However, it is contemplated within the scope of the invention that the spin vane may be adjustable. It is further contemplated within the scope of the invention that the spin vane may be mounted in the burner assembly at any suitable location and the spin vane blades may be of any suitable configuration, angle, number and/or spacing adapted to contribute to the swirling flow of air and the stability of the flame produced in the burner end. While FIGS. 1, 4, 6 and 11-13 illustrate only one spin vane section, i.e., the preferred spin vane 56, it is contemplated within the scope of the invention that more than one spin vane section may be included in the burner assembly.

Figure 6:
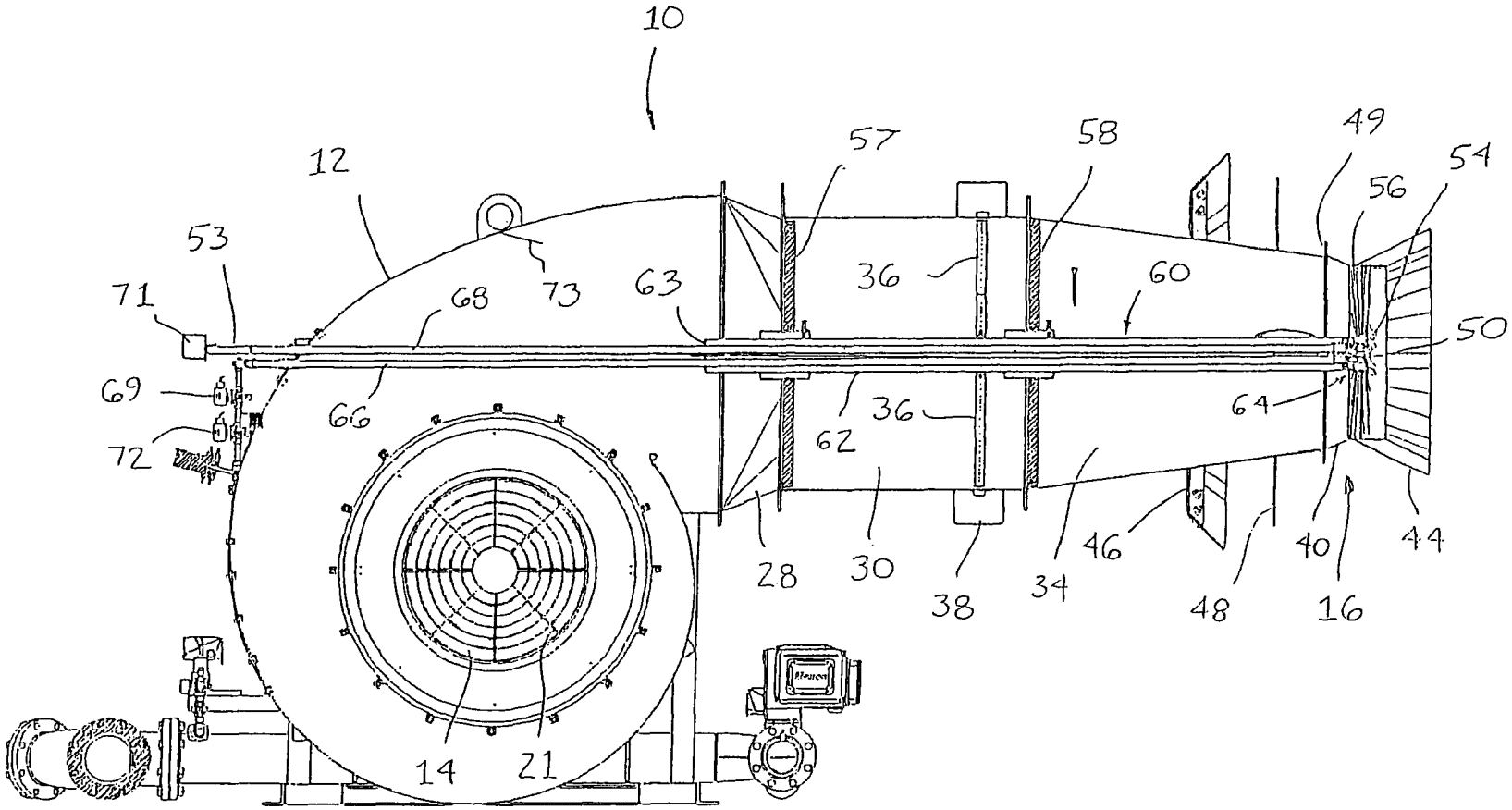
FIG. 6 is a partial sectional front view of the preferred embodiment of the burner assembly illustrated in FIGS. 1-5 taken along sectional line A-A of FIG. 4.
Figure 17:
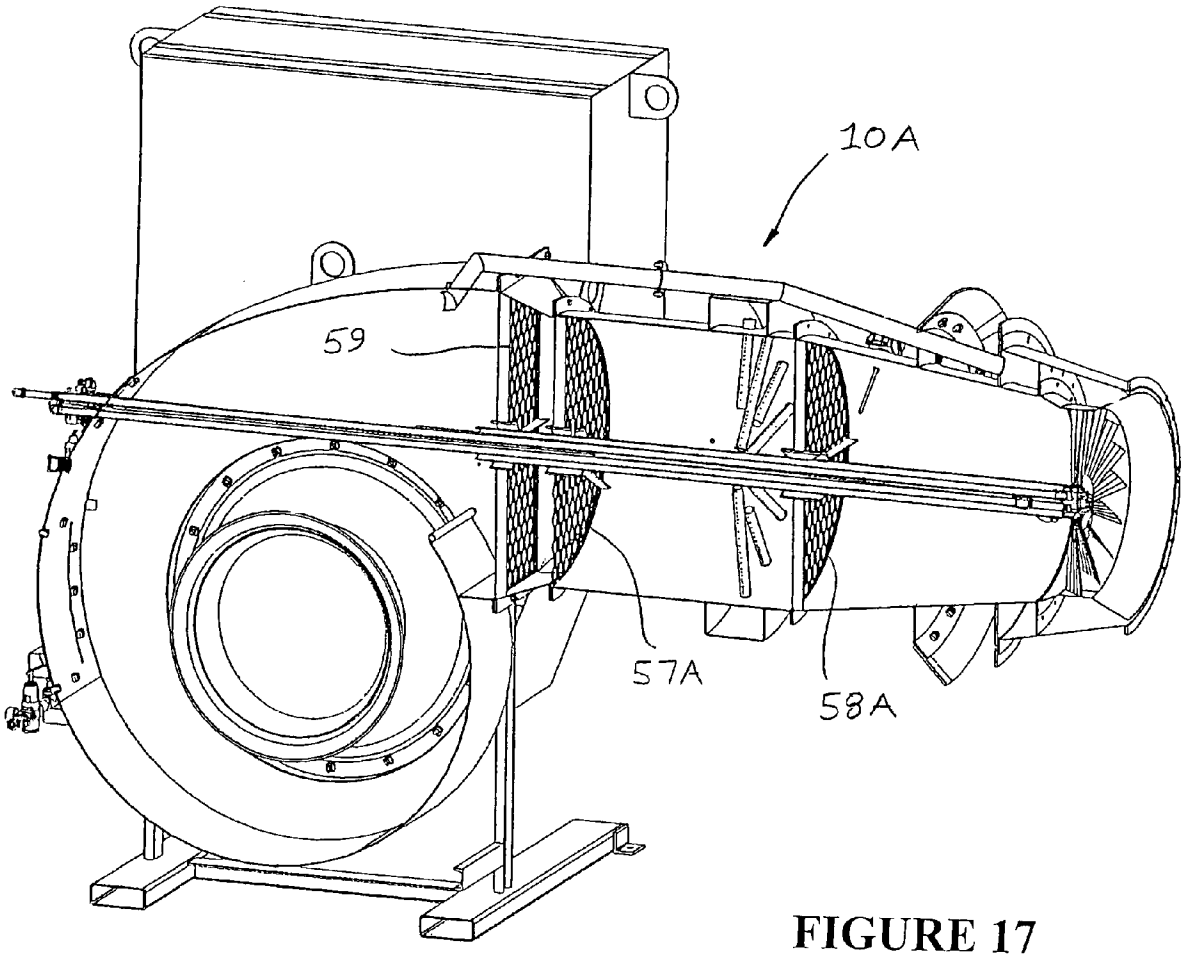
FIG. 17 is a partial sectional perspective view of a first alternative embodiment of the burner assembly in accordance with the present invention.

Referring now to FIGS. 4, 6, 7 and 7A, the preferred screens of the preferred burner assembly 10 are illustrated. More particularly, as shown in FIG. 6, the preferred burner assembly 10 includes straightening screen 57 and mixing screen 58. The preferred straightening screen 57 is mounted in the housing of the burner assembly downstream from the impeller and adapted to produce a uniform air flow velocity in the burner assembly. The preferred mixing screen 58 is mounted in the housing of the burner assembly and adapted to produce a uniform air flow velocity in the burner assembly and mix combustion air and fuel in the burner assembly. The preferred straightening screen 57 is mounted upstream of the pre-mix gas injection nozzles and the preferred mixing screen 58 is mounted downstream from the pre-mix gas injection nozzles, but it is contemplated within the scope of the invention that the screens may be mounted in any suitable location in the burner assembly. Referring now to FIG. 17, in an alternative embodiment, preferred burner assembly 10A also includes flattening screen 59. The preferred flattening screen 59 is adapted to flatten the blower air velocity profile and produce a more uniform fuel-air mixture in the burner assembly by eliminating fuel rich zones or pockets. As shown in FIG. 17, the preferred flattening screen 59 is located upstream from straightening screen 57A and mixing screen 58A. However, it is contemplated within the scope of the invention that the flattening screen may be located at any suitable location in the burner assembly and at any suitable location relative to the straightening screen and the mixing screen.

Figure 4:
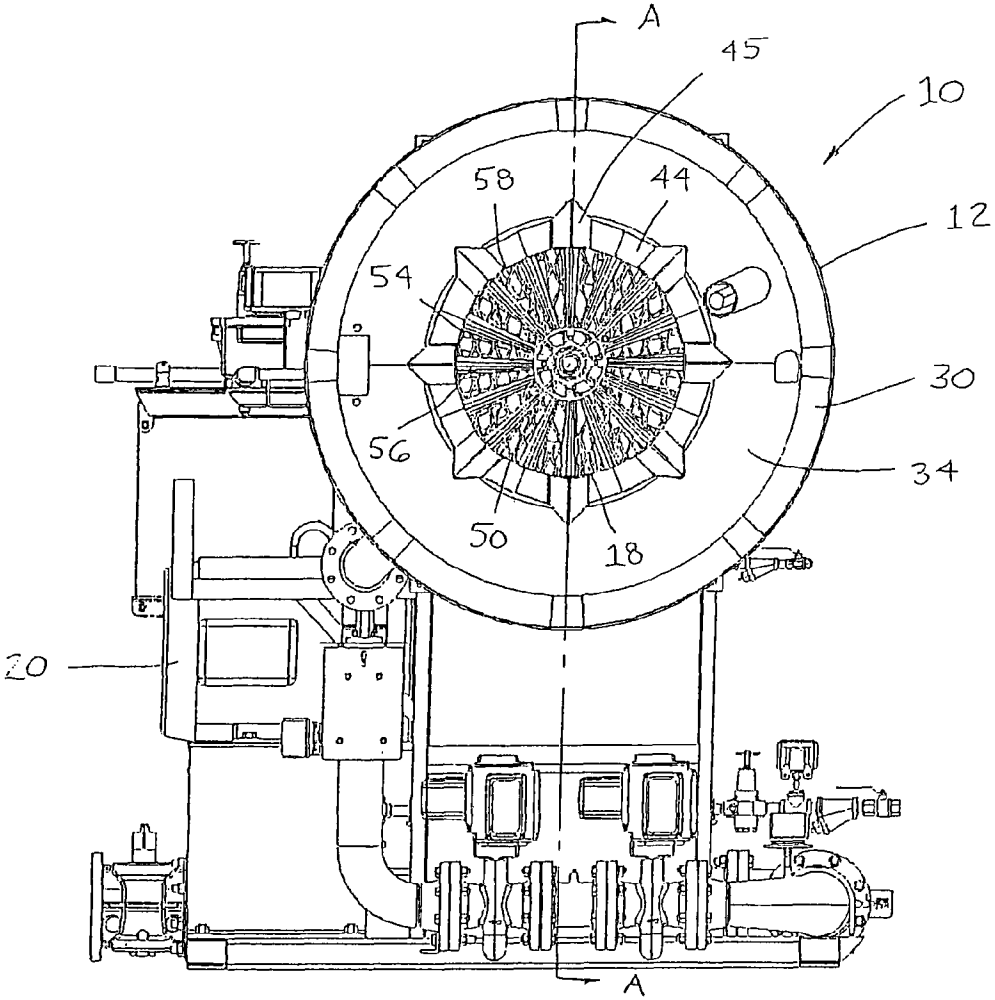
FIG. 4 is a right side view of the preferred embodiment of the burner assembly illustrated in FIGS. 1-3.

Referring now to FIGS. 5 and 6, a left side view and a partial sectional front view of preferred burner assembly 10 taken along line sectional A-A of FIG. 4 are illustrated, respectively. As shown in FIG. 5, the preferred pilot assembly 52, the preferred liquid fuel supply tube 66 and the preferred compressed atomizing air supply tube 68 enter housing 12 such that each may extend along the center of the housing and the interior of the burner assembly towards the burner end. See also FIG. 14. As shown in FIG. 6, the preferred burner assembly 10 includes a liquid fuel system referred to generally by reference numeral 60. The preferred liquid fuel system 60 includes primary air tube 62 which is mounted in the housing of the assembly. As can be appreciated from FIG. 6, some of the pressurized combustion air produced by motor 20 and impeller 21 (See FIGS. 1 and 2) enters the preferred primary air tube 62 at inlet end 63 which is located downstream of the impeller and upstream of the burner end. The preferred outlet end 64 is opposite inlet end 63 and located in the burner end of the assembly. The combustion air flowing through the primary air tube preferably flows past atomizing nozzle 50. In the preferred embodiment of the burner assembly, atomizing nozzle 50 is located at outlet end 63 of primary air tube 60.

Still referring to FIG. 6, in the preferred embodiment of the burner assembly 10, liquid fuel supply tube 66 is mounted within primary air tube 62 so as to convey liquid fuel (such as fuel oil) to atomizing nozzle 50. Also in the preferred embodiment of burner assembly 10, compressed atomizing air supply tube 68 is mounted within primary air tube 62 so as to convey compressed air to atomizing nozzle 50. Also in the preferred embodiment of burner assembly 10, means 69 is provided for conveying the liquid fuel through the liquid fuel supply tube at a pressure of between about 50 psi and about 100 psi. The preferred means 69 may be any suitable source for providing liquid fuel under pressure such as a pump and valve arrangement or the like. Also in the preferred embodiment of burner assembly 10, means 71 is provided for conveying compressed air through the compressed atomizing air supply tube at a pressure of between about 50 psi and about 100 psi. The preferred means 71 may be any suitable source for providing air under pressure such as a pump and valve arrangement. The combustion air conveyed to the atomizing nozzle by the preferred primary air tube 62 helps to eliminate large oil droplets or overspray from escaping the flame when the burner assembly is firing on liquid fuel.

Referring still to FIG. 6, the preferred burner assembly 10 is adapted to produce a stabilizing gas base flame (not shown) in the area of atomizing nozzle 50. More particularly, when the preferred burner assembly 10 is firing on gaseous fuel only, raw natural gas may be fed to the atomizing nozzle via the liquid fuel supply tube 66. Means 72 is provided to supply natural gas to the liquid fuel supply tube. Preferably, the amount of raw natural gas fed through the liquid fuel supply tube to produce the stabilizing gas base flame is approximately 1-2% of the total capacity of the burner assembly. The stabilizing gas base flame thus produced is not a pre-mix flame. Further, the preferred stabilizing gas base flame is adapted to be automatically shut off when the main flame is stable. The stabilizing gas base flame is adapted to enhance the stability of the main flame, particularly in the lower half of the range of the main flame.

Still referring to FIG. 6, the preferred burner assembly 10 includes air deflector 73. The preferred air deflector is mounted in housing 12 and is adapted to direct air flow from the impeller to the burner end. More particularly, the preferred air deflector 73 is mounted to the top of housing 12 and is adapted to uniformly direct air flow from the impeller to the top and the bottom of the housing.

Figure 7:
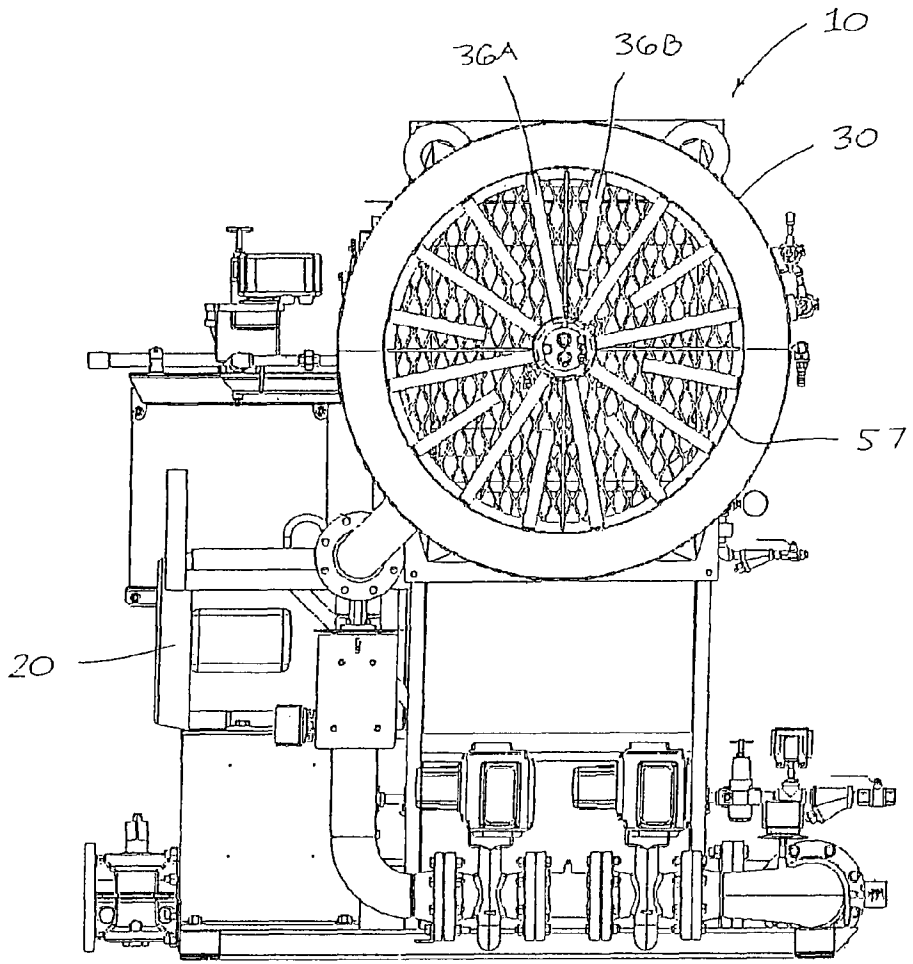
FIG. 7 is a partial sectional right side view of the preferred embodiment of the burner assembly illustrated in FIGS. 1-6 taken along sectional line B-B of FIG. 2.
Figure 7A:
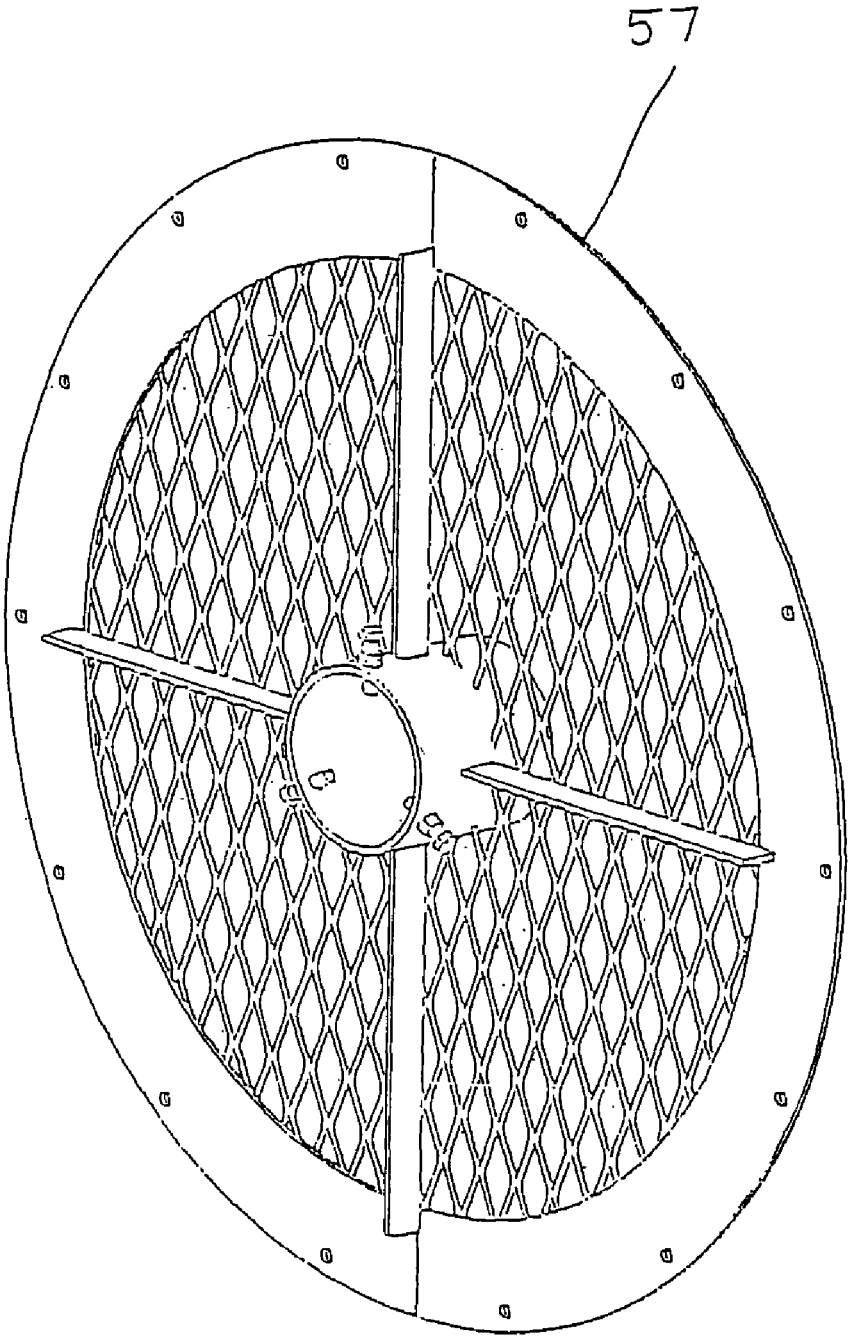
FIG. 7A is a perspective view of a preferred embodiment of a screen in accordance with the present invention.
Figure 8:
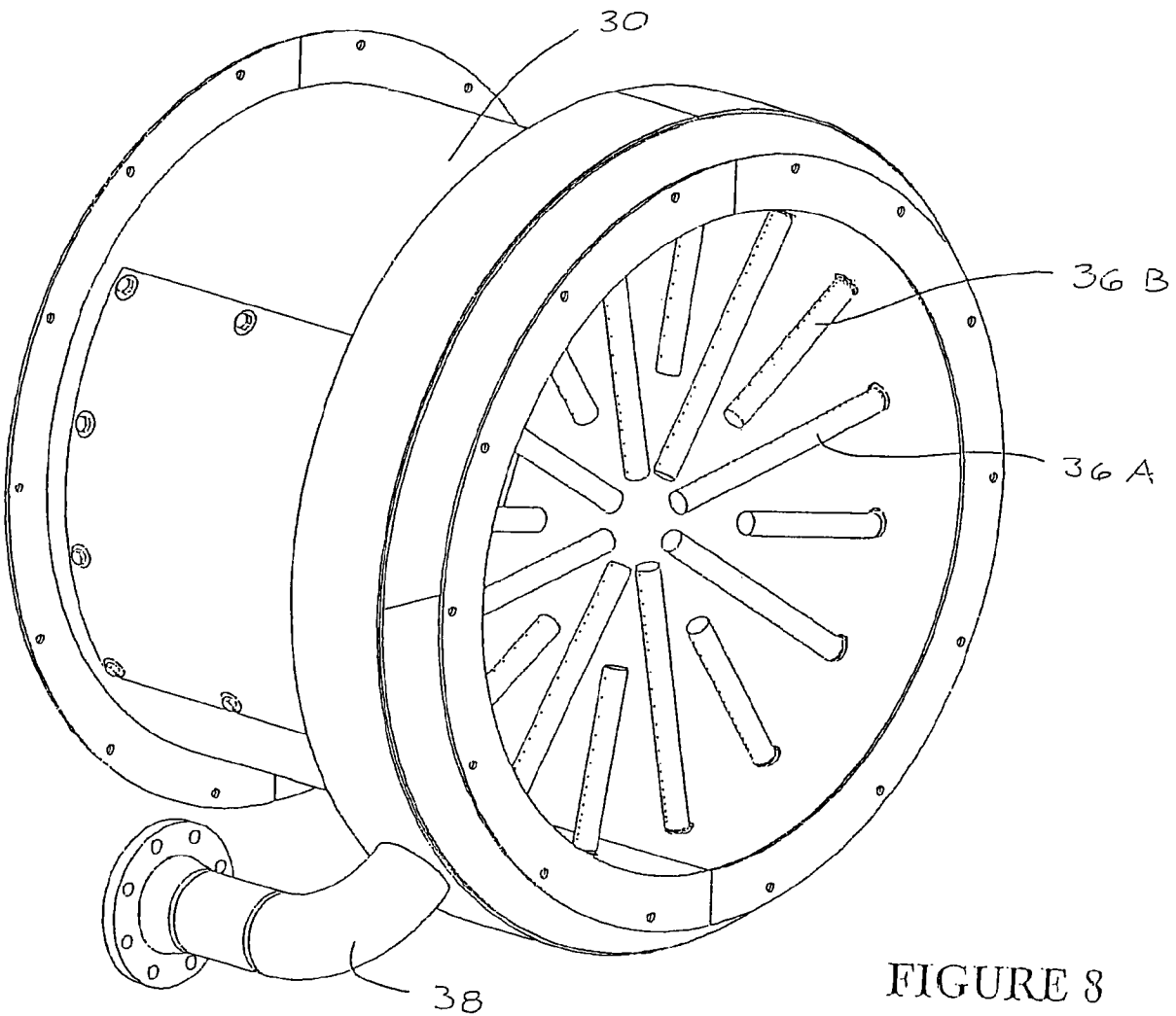
FIG. 8 is a perspective view of the preferred gas injection section of the burner assembly illustrated in FIGS. 1-7.

Referring now to FIGS. 7, 7A and 8, the preferred gas injection section 30 and straightening screen 57 of the preferred burner assembly 10 shown in FIGS. 1-6 are illustrated. More particularly, FIG. 7 illustrates a right side view of the preferred burner assembly 10 taken along sectional line B-B of FIG. 2. FIGS. 7 and 8 illustrate the plurality of preferred pre-mix gas injection nozzles 36A and 36B radially mounted in the preferred gas injection section 30. While FIGS. 7 and 8 illustrate a plurality of pre-mix gas injection nozzles mounted radially in the gas injection section, it is contemplated within the scope of the invention that one or more pre-mix gas injection nozzles may be arranged in any configuration suitable for mixing fuel and air. The preferred pre-mix gas injection nozzles 36A and 36B are mounted about the periphery of the housing of the burner assembly. Also shown in FIGS. 7 and 8, the preferred pre-mix gas injection nozzle 36A is longer than the preferred pre-mix gas injection nozzle 36B in order to produce a more uniform and complete mixture of fuel and air in the preferred burner assembly. It is contemplated within the scope of the invention, however, that the pre-mix gas injection nozzles may be any suitable length for uniformly and completely mixing the fuel and air in the burner assembly, provided that the pre-mix gas injection nozzles do not extend into the center of the burner assembly.

As shown in FIG. 7A, the preferred straightening screen 57 includes a plurality of openings through which combustion air flowing from the impeller to the burner end may flow. While the preferred straightening screen 57 is illustrated in FIG. 7A, it is contemplated within the scope of the invention that any suitable device having one or more openings adapted to permit combustion air to flow through may be used. For example, it is contemplated within the scope of the invention that a screen having larger or smaller openings that the screen illustrated in FIG. 7A may be used. It is further contemplated that the preferred straightening screen 57 may also be used as the preferred mixing screen 58. Like the preferred straightening screen, however, the preferred mixing screen may be any suitable device having one or more openings through which combustion air is adapted to flow.

Figure 9:
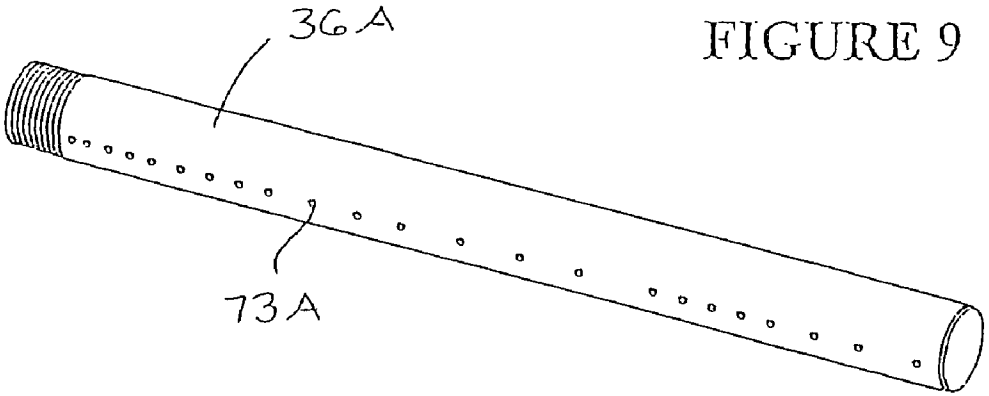
FIG. 9 is a perspective view of a first preferred embodiment of the pre-mix gas injection nozzles of the burner assembly illustrated in FIGS. 1-8.
Figure 10:
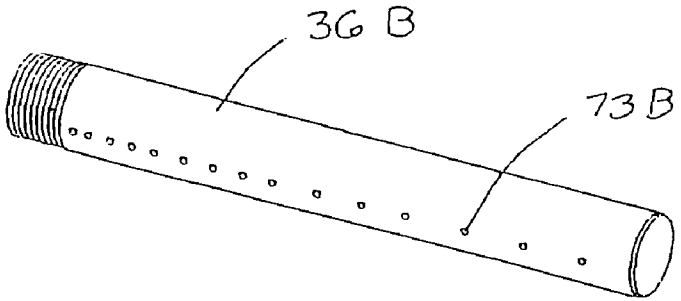
FIG. 10 is a perspective view of a second preferred embodiment of the pre-mix gas injection nozzles of the burner assembly illustrated in FIGS. 1-9.

Referring now to FIGS. 9 and 10, a pair of preferred pre-mix gas injection nozzles in accordance with the present invention are illustrated. More particularly, each of the preferred pre-mix gas injection nozzles 36A and 36B are generally cylindrical in shape and include at least one orifice, such as orifices 73A and 73B. It is understood that the pre-mix gas injection nozzles may be any suitable configuration, and the at least one orifice therein may be spaced at any location suitable for a uniform and complete mixing of fuel and air in the housing. The preferred orifice has a diameter of no more than about 0.172 inches.

Figure 11:
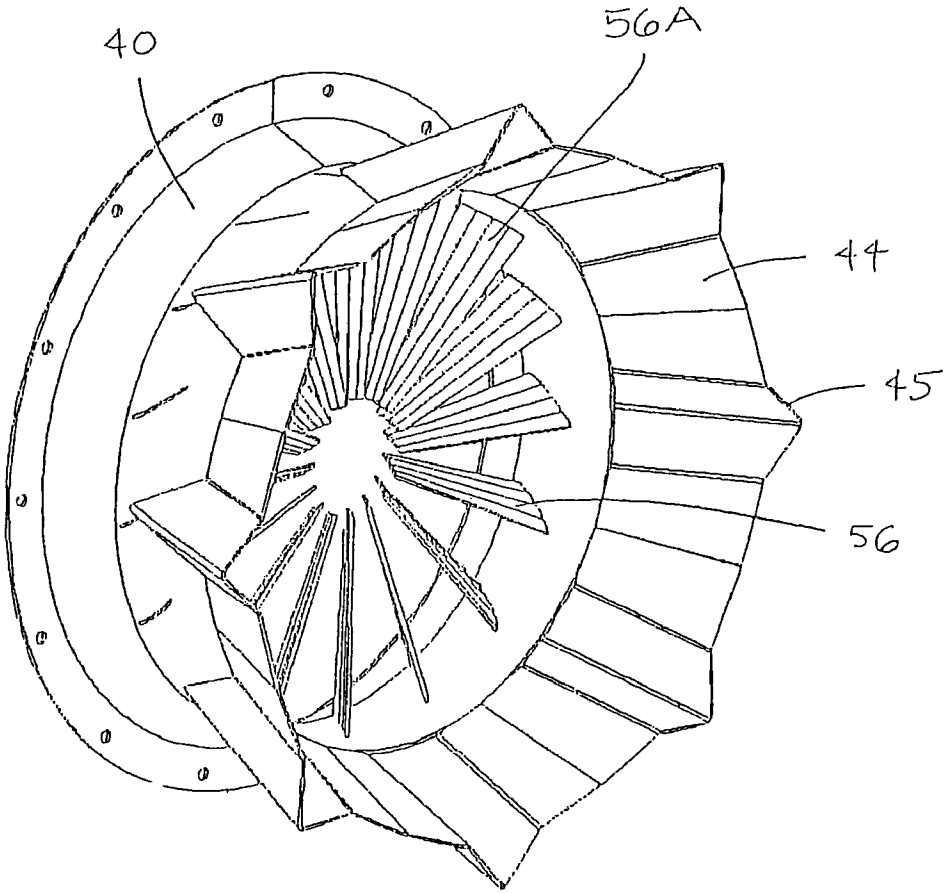
FIG. 11 is a perspective view of a portion of the preferred burner end of the burner assembly illustrated in FIGS. 1-10.
Figure 12:
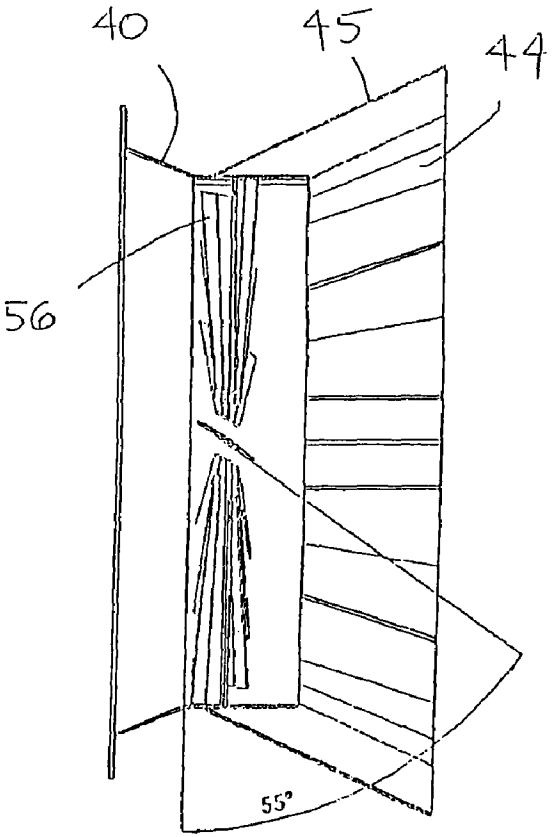
FIG. 12 is a partial sectional front view of a portion of the preferred burner end of the burner assembly illustrated in FIGS. 1-11.
Figure 13:
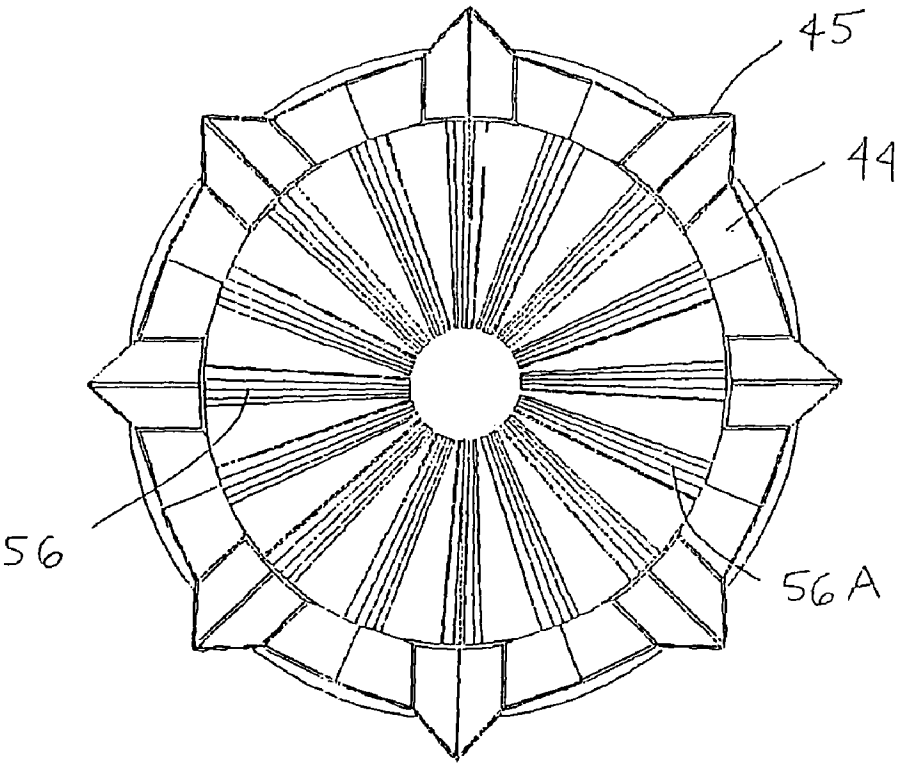
FIG. 13 is a right side view of a portion of the preferred burner end of the burner assembly illustrated in FIGS. 1-12.

Referring now to FIGS. 11-13, a portion of the preferred burner end of the burner assembly shown in FIGS. 1-10 is illustrated. More particularly, FIG. 11 is a perspective view, FIG. 12 is a partial sectional front view, and FIG. 13 is a right side view of a portion of the preferred burner end 16 of the preferred burner assembly 10 illustrated in FIGS. 1-10. As shown in FIGS. 11-13, the preferred burner end 16 of the preferred burner assembly 10 includes the preferred converging focusing cone 40, the preferred diverging conical discharge section 44 and the preferred spin vane 56. As shown in FIGS. 11-12, the preferred converging focusing cone 40 is located upstream of the preferred spin vane 56. As shown in FIG. 12, the preferred diverging conical discharge section 44 has an included angle of approximately 55°.

In operation, the several advantages of the burner assembly of the invention are achieved. For example, the preferred burner assembly is capable of selectively firing on gaseous fuel, liquid fuel, or both gaseous and liquid fuel. The preferred burner assembly is capable of firing on gaseous and/or liquid fuels without physically altering the components of the apparatus, changing the firing rate of the apparatus, or shutting down the apparatus. The preferred burner assembly is adapted to fire on oil or liquid propane by changing the pintle-style nozzle to a modified Y-Jet nozzle. The preferred burner assembly is capable of supplying natural gas or propane to the area around the atomizing nozzle for use as pilot fuel.

In addition, the preferred burner assembly produces a short, narrow and stable main flame configuration. The improved main flame configuration reduces the amount of combustion space required to heat and dry aggregate materials for the production of hot mix asphalt. The improved main flame configuration is adapted for use on a wide variety of different-sized combustion chambers having different-sized combustion spaces.

Further, the spacing and configuration of the spin vane, the ring, screens and the pre-mix gas injection nozzles in the preferred embodiment of the invention results in a flatter blower air velocity profile and a more complete and uniform mixture of combustion air, gaseous fuel and/or liquid fuel. The spin vane may be fixed because adjustment of the flame configuration is not required, even when using the burner assembly with a variety of different-sized dryer drums. As a result, costly and complicated adjustable spin vanes may be eliminated. In addition, the converging focusing cone section reduces the temperature of the dryer drum breech plate. Further, the more complete and uniform mixing of combustion air, gaseous fuel and/or liquid fuel reduces localized fuel rich zones or pockets that burn hot and cause an increase in thermal NOx. When firing on liquid fuels such as fuel oil or waste oils, the more complete and uniform mixing of combustion air and liquid fuel permits the burner to produce low CO emissions without excessive NOx emissions.

Still further, the configuration and arrangement of the preferred burner assembly provides improved aerodynamics. The configuration and arrangement of the preferred burner assembly more rapidly, completely, and uniformly mixes fuel and air, thereby providing a more rapid combustion, improving combustion intensity, reducing the combustion space required in the asphalt drum, and reducing CO emissions in the combustion space. The improved aerodynamics of the preferred burner assembly results in reduced energy consumption and body pressure. In addition, the improved aerodynamics of the preferred burner assembly produces a more free flowing burner assembly. Still further, the preferred burner assembly results in reduced noise levels during operation and reduced NOx emissions.

Additionally, the preferred burner assembly is capable of firing on low excess air pre-mix gas. The preferred burner assembly produces a stabilizing gas base flame. The preferred burner assembly is also less complicated and expensive to manufacture, operate and maintain than conventional burner assemblies.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, as would be understood and appreciated by a person having ordinary skill in the art to which the invention relates.

What is claimed is:

1. A burner assembly comprising:

(a) a housing having an air inlet and a burner end having an opening;

(b) a motor;

(c) an impeller mounted in the housing, said impeller being in fluid communication with the air inlet, in mechanical communication with the motor and adapted to direct air from the air inlet towards the burner end of the housing;

(d) at least one pre-mix gas injection nozzle mounted in the housing, each of said at least one pre-mix gas injection nozzle having at least one orifice adapted to direct gaseous fuel into the housing;

(e) a spin vane comprising at least one spin vane blade, said spin vane being mounted in the burner end of the housing and adapted to direct the flow of air in the burner end;

(f) a straightening screen mounted in the housing downstream from the impeller, said straightening screen having a substantially planar upstream side and a substantially planar downstream side and said straightening screen being adapted to produce a uniform air flow velocity in the burner assembly;

(g) an igniter mounted in the burner end of the housing, said igniter being adapted to ignite the air and fuel mixture in the burner end of the housing to produce a main flame; and, (h) a diverging conical discharge section located in the burner end, said diverging conical discharge section includes at least one expansion and contraction crease.

2. The burner assembly of claim 1 wherein the motor is a variable speed motor.

3. The burner assembly of claim 1 wherein the at least one pre-mix gas injection nozzle is mounted about the periphery of the housing.

4. The burner assembly of claim 1 wherein each of the at least one orifice in the at least one pre-mix gas injection nozzle has a diameter of no more than about 0.172 inches.

5. The burner assembly of claim 1 wherein the spin vane is fixedly mounted in the burner end.

6. The burner assembly of claim 1 wherein each of the at least one spin vane blade of the spin vane is tapered.

7. The burner assembly of claim 1 wherein each of the at least one spin vane blade of the spin vane has a non-planar cross-sectional shape.

8. The burner assembly of claim 1, further including:

(g) an air deflector mounted in the housing, said air deflector being adapted to direct air flow from the impeller to the burner end.

9. The burner assembly of claim 1, further including:

(h) a transition section located downstream of the impeller and adapted to direct air flow from the impeller to the burner end.

10. The burner assembly of claim 1, further including:

(i) a seal skirt mounted adjacent to the burner end, said seal skirt being adapted to prevent air from entering a dryer drum.

11. The burner assembly of claim 1, further including:

(j) a heat shield mounted adjacent to the burner end, said heat shield being adapted to be attached to a rotating dryer drum and prevent air from entering said dryer drum.

12. The burner assembly of claim 1 wherein the burner assembly further includes a mixing screen adapted to produce a uniform air flow velocity in the burner assembly and mix combustion air and fuel in the burner assembly.

13. The burner assembly of claim 1, further including:

(l) a pre-mix cone located downstream from the impeller and adapted to direct air flow from the impeller to the burner end.

14. The burner assembly of claim 13 wherein the pre-mix cone has an included angle of approximately 15°.

15. The burner assembly of claim 1, further including:

(m) a converging focusing cone located in the burner end, said converging focusing cone being adapted to accelerate the velocity of air flow in the burner end.

16. The burner assembly of claim 15 wherein the converging focusing cone is removably mounted to the burner assembly.

17. The burner assembly of claim 1, further including:

(o) an primary air tube mounted within the housing, said primary air tube having an inlet end and an outlet end, said inlet end being located downstream of the impeller and said outlet end being located in the burner end;

(p) an atomizing nozzle located at the outlet end of the primary air tube;

(q) a liquid fuel supply tube mounted within the primary air tube, said liquid fuel supply tube being adapted to convey liquid fuel to the atomizing nozzle;

(r) a swirl plate mounted around the periphery of the outlet end of the primary air tube;

(s) a compressed atomizing air supply tube mounted within the primary air tube, said compressed atomizing air supply tube being adapted to convey compressed air to the atomizing nozzle.

18. The burner assembly of claim 17 wherein the burner assembly is adapted to selectively fire on gaseous fuel, liquid fuel or both gaseous fuel and liquid fuel.

19. The burner assembly of claim 17 wherein the liquid fuel supply tube is adapted to convey gaseous fuel to produce a stabilizing gas base flame in the burner end.

20. The burner assembly of claim 17 wherein the swirl plate mounted around the periphery of the outlet end of the primary air tube is a flat round disk.

21. The burner assembly of claim 17, further including:

(t) a pilot assembly mounted at the burner end, said pilot assembly being adapted to produce a pilot flame.

22. The burner assembly of claim 21 wherein the pilot assembly is centrally located in the housing of the burner assembly and surrounds at least a portion of the atomizing nozzle.

* * * * *